US006993796B1

(12) United States Patent
Hammond et al.

(10) Patent No.: US 6,993,796 B1
(45) Date of Patent: Feb. 7, 2006

(54) DISPENSER FOR RELEASING A SUBSTANCE INTO A TOILET BOWL

(75) Inventors: Geoffrey Robert Hammond, Hull (GB); Yannic Hermouet, Verneuil sur Seine (FR)

(73) Assignee: Reckitt Benckiser France, Massy (FR)

( * ) Notice: Subject to any disclaimer, the term of this patent is extended or adjusted under 35 U.S.C. 154(b) by 0 days.

(21) Appl. No.: 09/913,130

(22) PCT Filed: Feb. 14, 2000 (Under 37 CFR 1.47)

(86) PCT No.: PCT/GB00/00466

§ 371 (c)(1), (2), (4) Date: Apr. 24, 2002

(87) PCT Pub. No.: WO00/49238

PCT Pub. Date: Aug. 24, 2000

(30) Foreign Application Priority Data

Feb. 16, 1999 (EP) ..... 99400368
Mar. 10, 1999 (GB) ..... 9905445

(51) Int. Cl.
*E03D 9/02* (2006.01)

(52) U.S. Cl. ..... 4/231

(58) Field of Classification Search ..... 4/223–224, 4/231

See application file for complete search history.

(56) References Cited

U.S. PATENT DOCUMENTS

| | | | | |
|---|---|---|---|---|
| 927,132 A * | 7/1909 | Duenwald | 4/231 |
| 1,129,066 A * | 2/1915 | Brown | 4/231 |
| 1,145,669 A * | 7/1915 | Brown | 4/231 |
| 4,318,193 A | 3/1982 | Bayer et al. | 4/222 |

FOREIGN PATENT DOCUMENTS

| | | |
|---|---|---|
| GB | 11185 | 0/1913 |
| GB | 1 235 144 | 6/1971 |
| GB | 2 125 462 A | 3/1984 |
| WO | WO 98/45543 | 10/1998 |

* cited by examiner

*Primary Examiner*—Charles E. Phillips
(74) *Attorney, Agent, or Firm*—Fish & Richardson P.C.

(57) ABSTRACT

A dispenser for releasing a treatment substance into a toilet bowl, said dispenser being in the form of an elongate tubular member, adapted to release the substance when the toilet is flushed, and resilient so that in use it is self-supporting under the rim of the bowl. The substance to be released is at least one of a bleach, cleanser, surfactant, perfume or disinfectant.

24 Claims, 10 Drawing Sheets

FIG. 1.
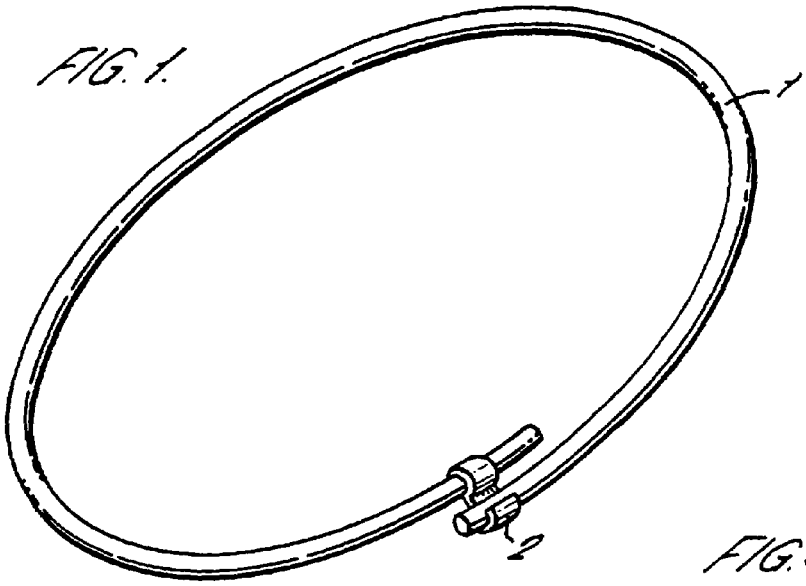
FIG. 3.
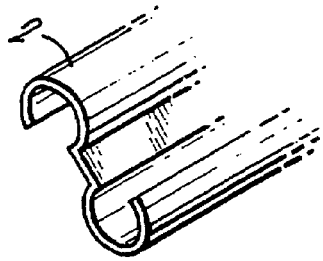
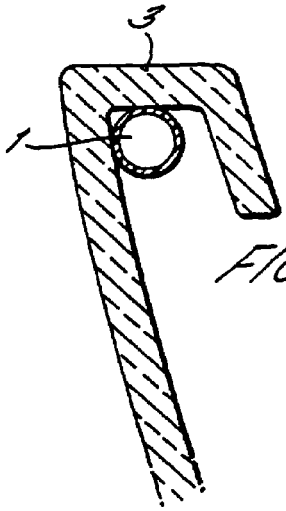
FIG. 2.
FIG. 4.
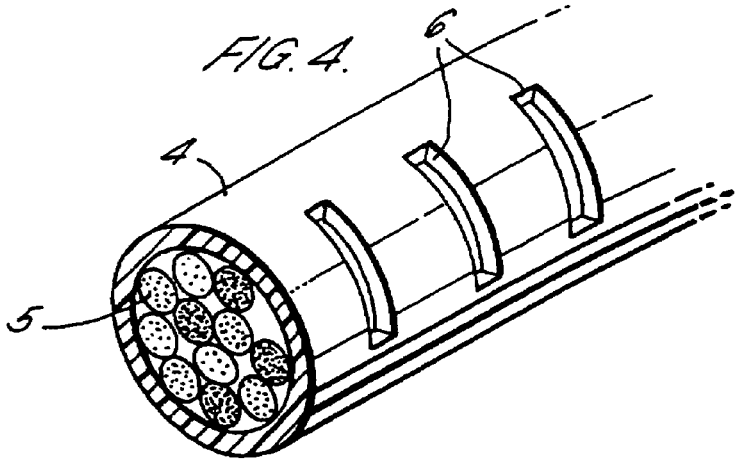

FIG. 12.
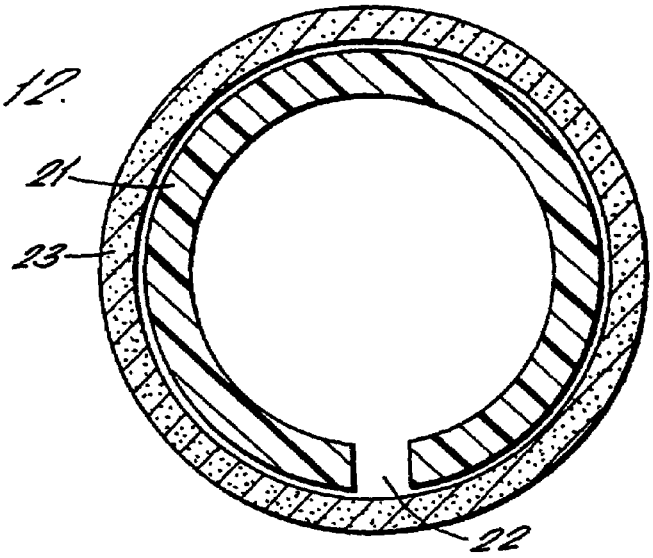
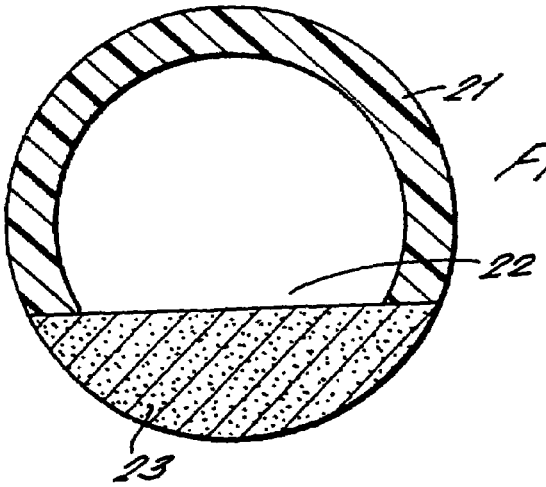
FIG. 13.
FIG. 14.
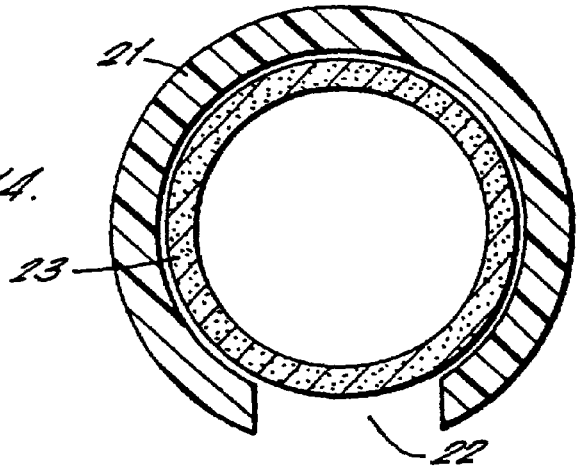

FIG. 23.
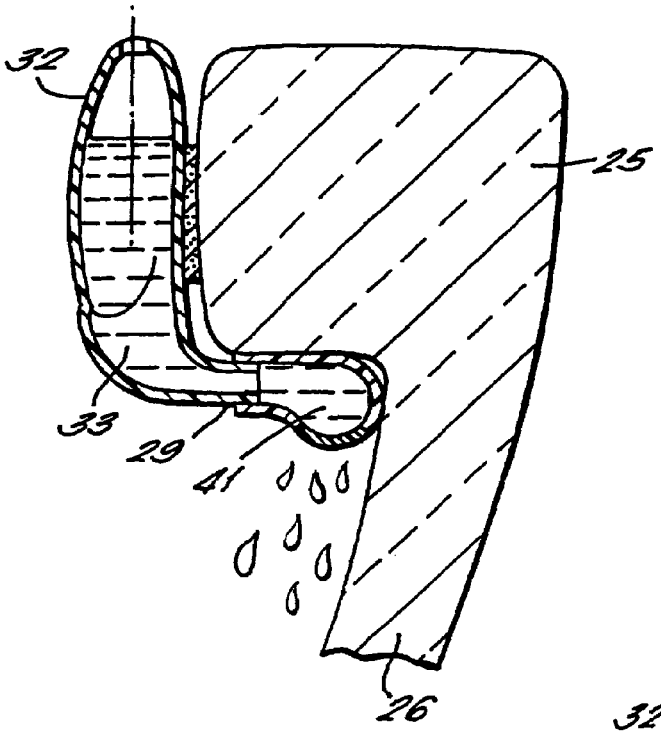
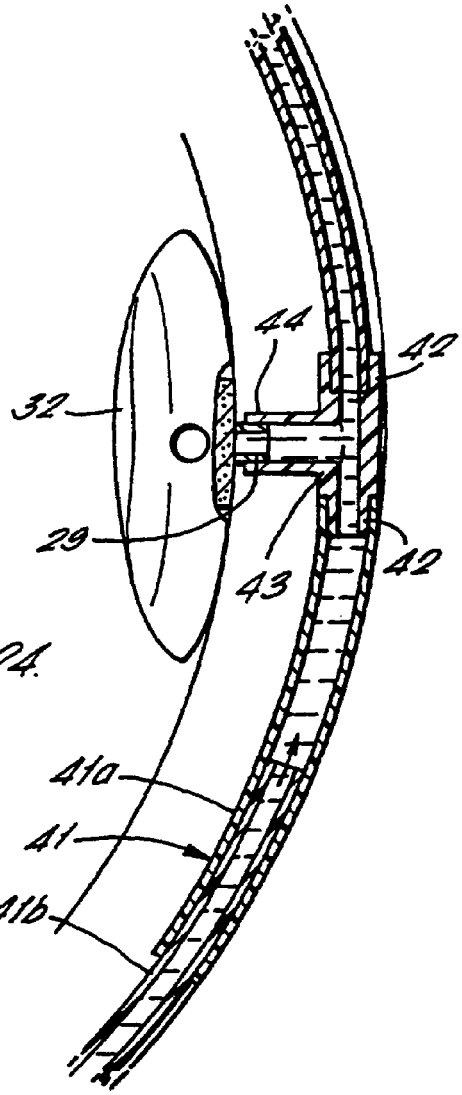
FIG. 24.

DISPENSER FOR RELEASING A SUBSTANCE INTO A TOILET BOWL

The present invention relates to a dispenser for releasing a substance into a toilet bowl.

BACKGROUND OF THE INVENTION

It is well known to provide dispensers for releasing substances such as bleaches, cleaners or disinfectants gradually or intermittently into toilet bowls. These usually take the form of a solid block adapted to be held near the rim of the bowl. Recently more complex arrangements wherein the substance is in liquid or gel form have also been developed. One problem with all of these arrangements is that the substance is dispensed only at one part of the rim. This means that the substance may not adequately be dispersed around the whole bowl, for example to provide an adequate cleaning or bleaching effect on all visible surfaces.

SUMMARY OF THE INVENTION

The present invention provide a dispenser for releasing a substance into a toilet bowl, comprising an elongate resilient member provided with means for retaining a substance and at least partially releasing the substance when the toilet is flushed, wherein said member is of sufficient resilience and length so that it is longitudinally self-supportable under the rim of a toilet bowl.

BRIEF DESCRIPTION OF THE DRAWINGS

The invention will now be described, by way of example only, with reference to and as shown in the accompanying drawings in which:

FIG. 1 is a perspective view of one embodiment of the dispenser of the invention;

FIG. 2 is a cross-sectional side elevation of a section of a toilet bowl illustrating the location of the dispenser in use;

FIG. 3 is a perspective view of a means for joining the two ends of the dispenser;

FIGS. 4 to 14 are perspective and cross-sectional end elevations of sections of different embodiments of the dispenser;

FIGS. 17 to 23 are perspective and cross-sectional end elevations of sections of toilet bowl illustrating alternative filling systems for the dispenser; and FIG. 24 is a plan view of a section of a toilet bowl illustrating the filling system of FIG. 23 and means to adjust the length of the dispensing member.

DETAILED DISCLOSURE

Figure 5:
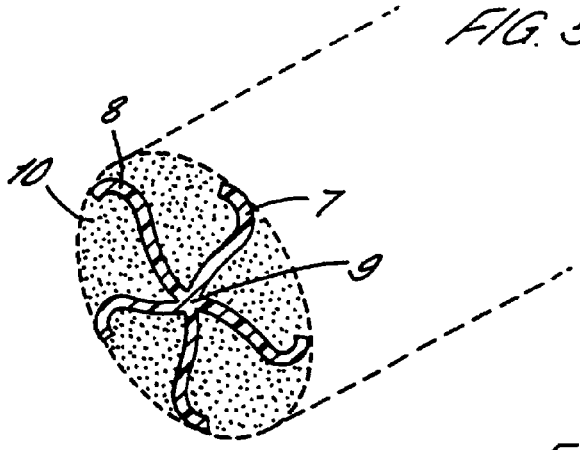

FIGS. 1 to 3 illustrate an embodiment of a dispenser of the present invention. The dispenser is in the form of a flexible, resilient, elongate member (1) which, in use, comprises or contains the substances to be released into the toilet bowl. The dispenser is longitudinally self-supporting under the rim (3) of a toilet bowl. The member (1) is, in use, preferably formed into a circular or near-circular loop of the approximate shape of the toilet bowl. Nevertheless, it need not be a complete band, so long as it is long enough and sufficiently resilient such that it is longitudinally self-supporting under the rim (3) of the bowl. Desirably the member (1) has a length such that, in use, the substance is released into the toilet bowl around the entire circumference of the rim (3) of the bowl.

The dispenser may comprise means (2) to alter the circumferential length of the loop, although this is not an essential feature. This may take the form of a "S" shaped clip made of a resilient material adapted to hold the elongate member at each of its ends. The circumferential length of the loop can be adjusted by sliding either one or both ends of the member (1) through the clip.

Since the member (1) is flexible and resilient it naturally tries to spring back to its straight form. However, due to the constraint either of adjusting means (2) on the member (1) or the shape of the toilet bowl (if the adjusting means (2) is not present) it cannot achieve this and therefore simply expands to a circular or near-circular loop of the maximum diameter possible, which means that the dispenser will naturally place itself under the rim of the toilet bowl once it has been put into approximate position, as shown in FIG. 2. If the band has a circumference which is less than that of the rim (3) of the toilet bowl, for example because the adjusting means (2) is used to limit the circumference of the band to less than that of the rim (3), the dispenser will simply sit at the part of the toilet bowl having the same circumference, although this is not preferred since the active substance is not then released into the bowl above the dispenser.

The elongate member (1) may be made of any suitable flexible, resilient material. It is preferably an extruded polymer, for example polypropylene.

It is an essential feature of the dispenser that it is adapted to release a substance when the toilet is flushed. The dispenser may release all of the substance when the toilet is flushed, but it is preferred that only part of the substance is released so that the dispenser can be left in place for a number of flushes in a similar manner as a conventional in-the-bowl (ITB) toilet block. The substance which is released may be any substance which it is desired to release into or onto a toilet bowl; for example the substance may comprise at least one of a bleach, cleaner, surfactant, perfume or disinfectant. The dispenser may release perfume between flushes, and therefore provide a continuous fragrancing action. The dispenser is preferably constructed and the formulation of the substance is preferably chosen such that the dispenser does not leak, drip or otherwise release the substance except when the toilet is flushed.

The dispenser can take any form which enables this function to be fulfilled. Thus, for example, as shown in FIG. 4 it may be in the form of a tube (4) containing the substance in powder form (5). The substance could also be in gel form. The tube (4) is porous so that flush water washes over and at least partially enters the tube (4), dissolving or dispersing the powder (5) so that some is released. The tube (4) may be perforated by the provision of a plurality of slits (6) along its length. To ensure that the powder (5) does not simply fall out of the tube the slits (6) may be on the upper part of the tube when the dispenser is in use, or the powder may be of suitably large size. For example the powder may be granulated by conventional means so that the granular particles have a larger size than that of the slits (6). The tube may also be made porous by other means, for example by having at least part of its surface made from a porous material which allows liquid but not solid substances to pass through. Another embodiment is for the non-porous tube to contain a single, elongate slit along substantially its entire length.

A further embodiment is depicted in FIG. 5 which shows the dispenser in the form of a flexible skeleton (7). The skeleton (7) has a cross-section consisting of a number of arms (8), for example from 3 to 6, preferably 4 or 5, joined at the centre (9). These arms (8) take a form such that they can hold in place the substance (10). The substance (10) may be, for example, a gel or solid such as a soap. The substance may simply be extruded onto the skeleton.

Figure 6:
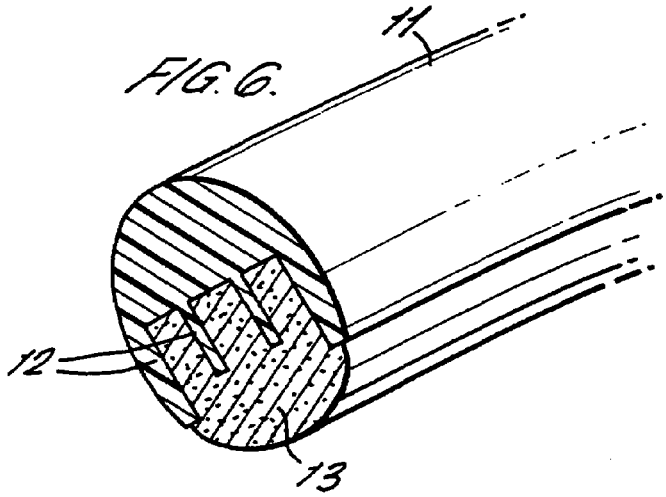
Figure 7:
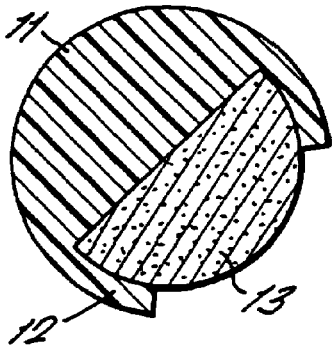
Figure 8:
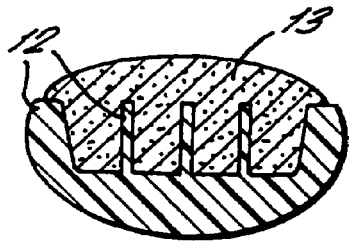

FIGS. 6 to 8 illustrate a further embodiment in which the dispenser is in the form of a solid member (11). The member comprises a number of protrusions (12) so that it can engage and hold the substance (13) on one side of the member (11). The substance (13) may be, for example, a gel or solid such as a soap or crystalline salt. FIG. 6 illustrates an embodiment where there are four, essentially straight protrusions (12). FIG. 7 illustrates an embodiment wherein there are only two circumferential protrusions (12) which extend partially around the substance (13). FIG. 8 illustrates an embodiment where there are five protrusions (12).

Figure 9:
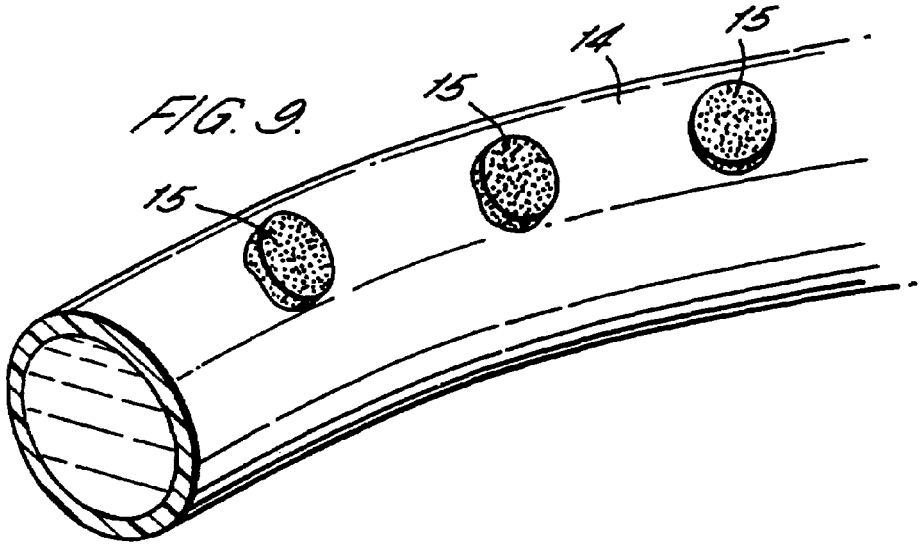
Figure 10:
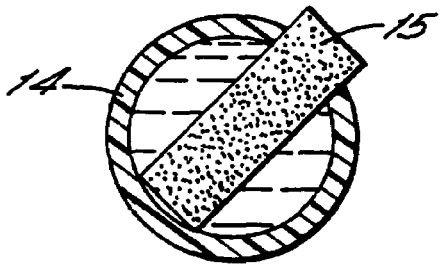
Figure 11:
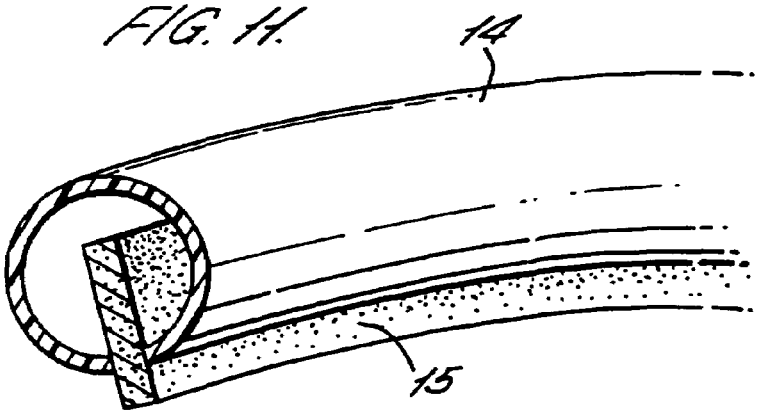

A yet further embodiment is shown in FIGS. 9 and 10 in which the dispenser comprises a tube (14) containing a plurality of porous inserts (15), for example of paper or sponge. Alternatively, as shown in FIG. 11 the porous insert (15) may be a continuous insert in the form of an elongate member running along the entire length of the tube (14). The dispenser can hold the substance in liquid form. In use the porous inserts (15) become saturated with the liquid and release part of it when washed with flush water.

FIGS. 12, 13 and 14 illustrate further embodiments of the dispenser. The dispenser in these embodiments is in the form of a tube (21). The tube (21) contains the substance in liquid form. The liquid may have a low viscosity or may be thickened slightly. The tube (21) has a continuous elongate slit (22) along its entire length. The slit is preferably on the lower surface of the dispenser but may be, for example, on the upper surface or any other surface. As alternative embodiments the slit (22) may be non-continuous such that the tube contains a plurality of smaller slits (22) along its length. A porous material (23), for example of paper or sponge, is placed so it covers or fills the entire continuous elongate slit (22) or all of the plurality of smaller slits (22). The porous material (23) may be continuous or, if there are a plurality of smaller slits (22) may comprise a plurality of sections, each section associated with one or more smaller slits (22).

These different embodiments are shown in FIGS. 12 to 14. FIG. 12 shows a porous material (23) in the form of a cylinder encapsulating the tube (21). FIG. 13 shows a porous material (23) in the form of an arcuate section attached to the tube (21). The porous material may be held in place by any suitable means, for example by an adhesive. FIG. 14 shows a porous material (23) in the form of a cylinder held within the tube (2*i*). These embodiments work in a similar means to the embodiment shown in FIGS. 9 to 11.

Figure 15:
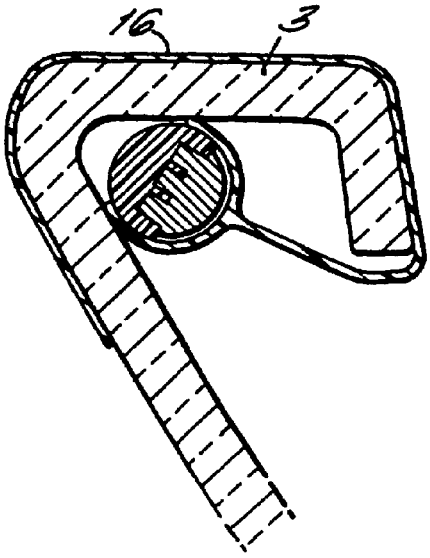
FIG. 15 is a cross-sectional side elevation of a section of a toilet bowl illustrating an embodiment of a dispenser having a hook to enable its easy removal after use.

The dispenser may comprise removal means, such as a hook (16) adapted to be placed around the outer rim (3) of the toilet bowl, to enable the dispenser to be removed from the bowl after use. This is illustrated in FIG. 15. The hook (16) is preferably made from a resilient material, for example the same material as the remainder of the dispenser. One or more hooks (16), for example 1, 2, or 3, may be provided. As an alternative embodiment the dispenser may be removed simply by pulling it out from the bowl after use, preferably by means of a separate tool adapted to engage and hold the dispenser.

The dispenser may be sold in elongate form or in a form in which it already forms a loop. It may or may not already comprise the substance to be released in the bowl. For some embodiments of the dispenser such as that shown in FIG. 5 where a gel (10) has to be extruded onto the member (7) it is essential that the dispenser already comprises the substance. In other embodiments the dispenser may be sold either containing or not containing the substance. In these embodiments the dispenser may be filled or refilled by the consumer. For example 1*f* the dispenser is in the form of a hollow tube it may contain an end cap which a consumer may remove to fill the tube with the substance in solid, gel or liquid form, following which the cap is replaced. Another possibility is for the cap to contain a lid which can be removed and replaced. If the substance is in liquid form an inlet may be provided at any place on the dispenser for liquid to be injected from a suitable container. This embodiment is preferred since the dispenser may simply be left in place on the lavatory bowl while it is refilled. The substance used for filling or refilling the dispenser may be provided, for example, in a suitable container such as a bottle, tube or aerosol.

Figure 16:
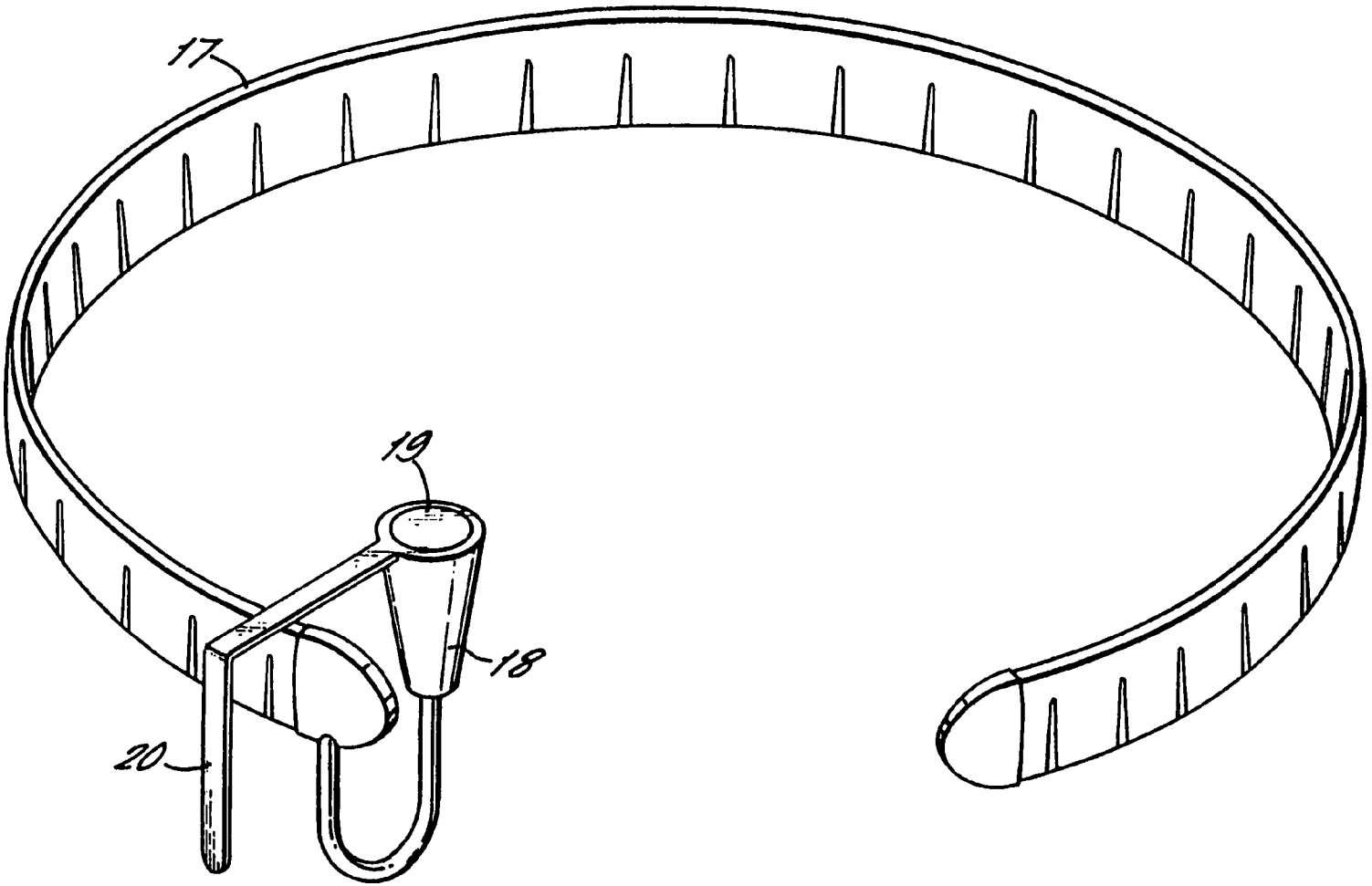
FIG. 16 is a perspective view of an embodiment of the dispenser having an end cap for filling or refilling the dispenser.

FIG. 16 illustrates an embodiment wherein a dispenser (17) is provided with an end cap (18) which serves as an inlet means for a consumer to fill or refill the dispenser. The consumer opens the lid (19) and fills the dispenser (17) with a substance provided in, for example, a bottle. The cap (18) also comprises a clip (20) to hold the cap upright so that it can easily be refilled. However, such a clip (20) does not have to be present if the cap (18) is already sufficiently rigid or if the cap (18) does not have to be held upright because, for example, an aerosol is used to fill or refill the dispenser. As an alternative embodiment the refilling means can be provided at any position along the dispenser, for example in the middle.

Figure 17:
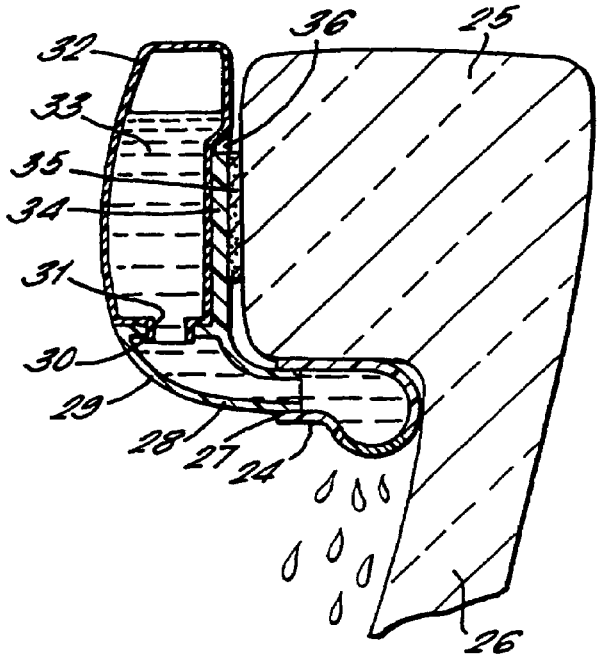
Figure 18:
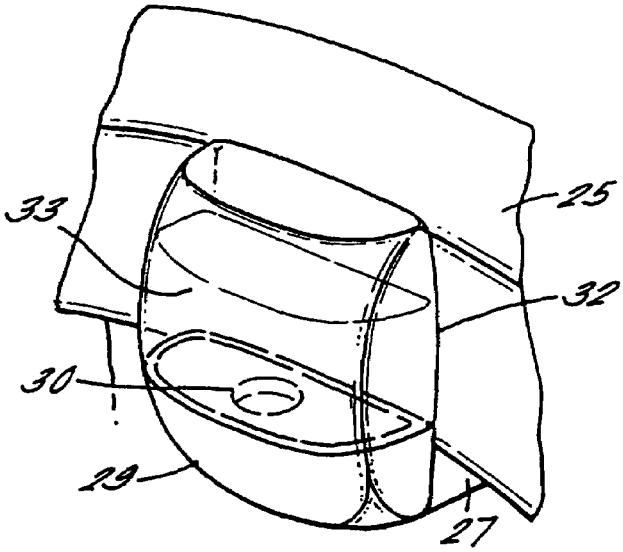

Alternative filling systems are illustrated in FIGS. 17 to 24. In FIG. 17 there is shown a dispenser (24) located under the rim (25) of a toilet bowl (26). The dispenser (24) is provided with an aperture (27) for receiving the nozzle (28) of funnel (29). Funnel (29) is provided with a port (30) for receiving an outlet (31) of a container (32) for storing the substance (33). The funnel (29) may be provided with a flange (34) to the rear of which may be a double sided adhesive patch (35) which adheres to the toilet bowl rim (25) to hold the funnel (29) in position. The container (32) is positioned on the funnel (29) with the container outlet (31) located within the port (30) and the funnel flange (34) locating in a slot (36) formed on the back of the container (32). Thus the substance (33) flows out of the container (32), through the funnel (29) and into the dispenser (24). This embodiment of the invention is particularly advantageous as the containers (32) may be sold separately as re-fill cartridges and can easily be used to replace the old container (32) once it is empty.

Figure 19:
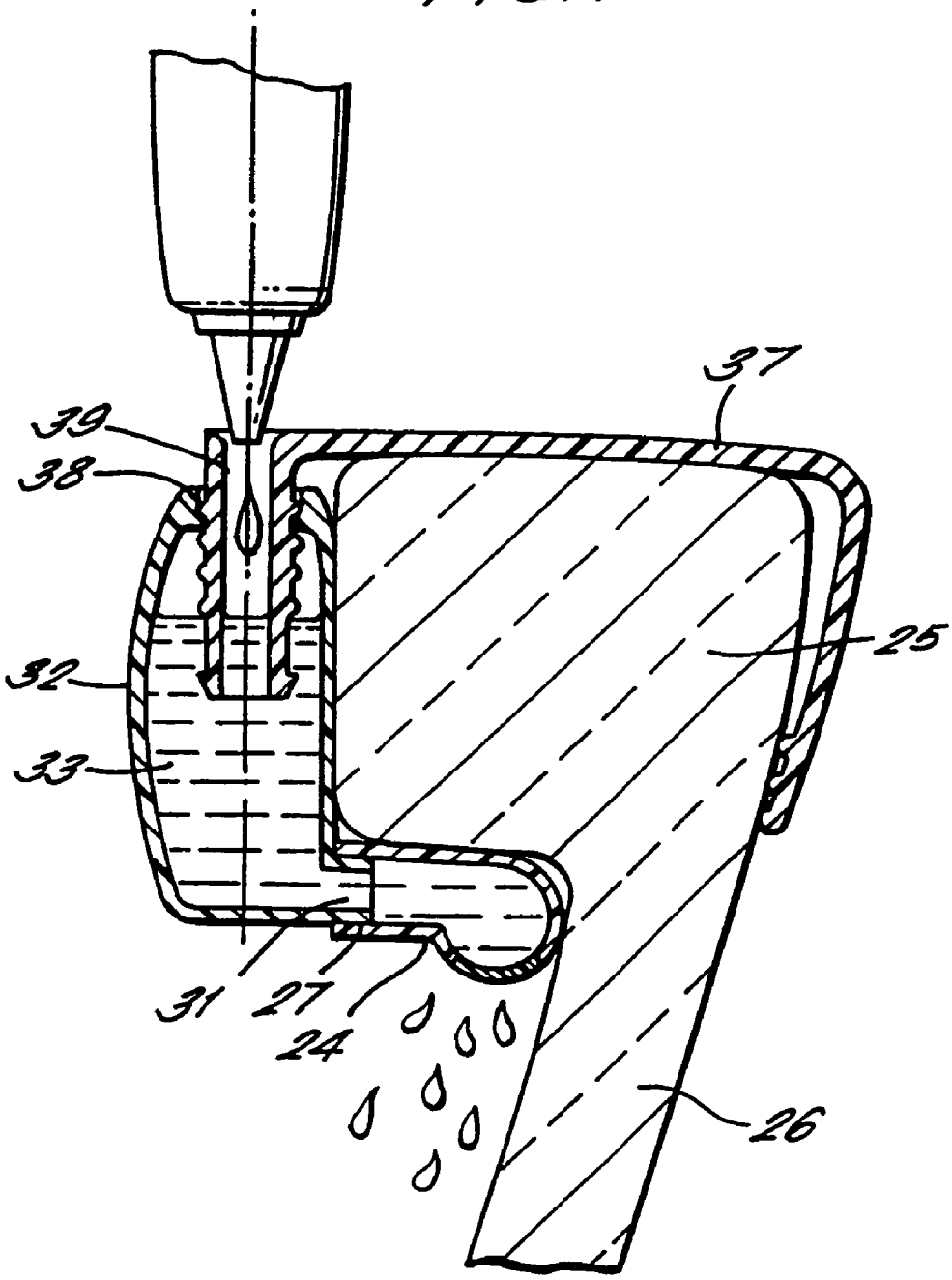
Figure 20:
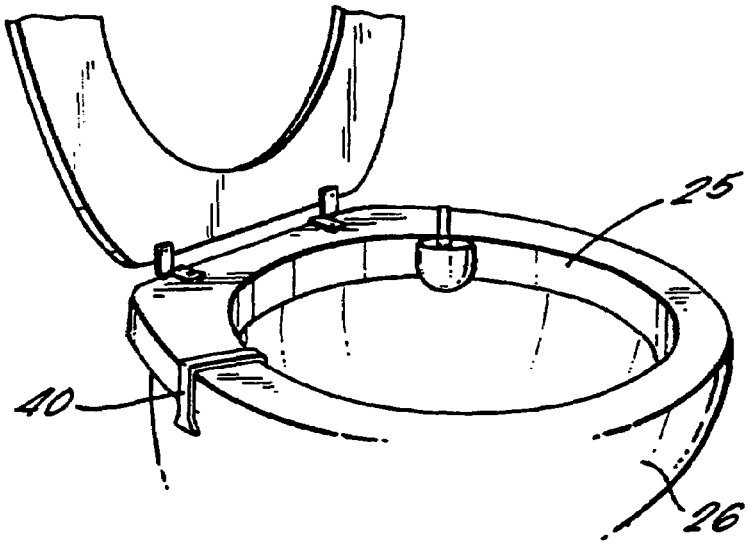
Figure 21:
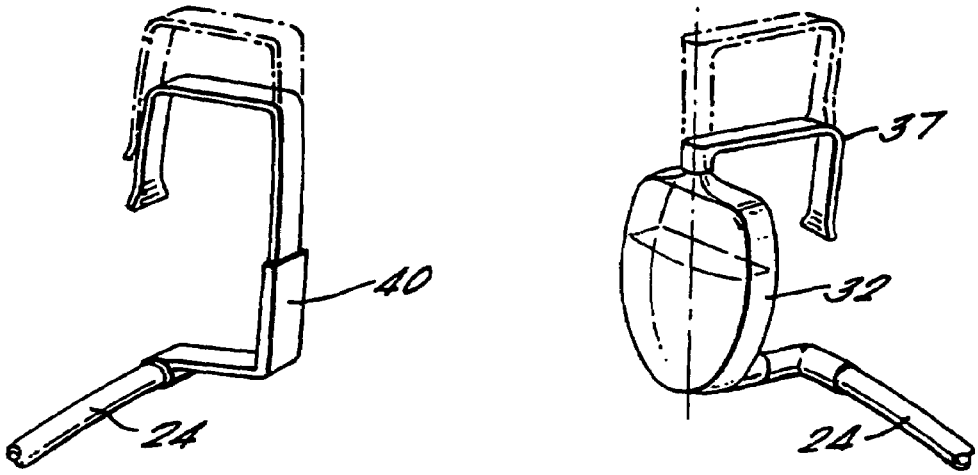

An alternative filling system is illustrated in FIGS. 19 to 21. In this embodiment the container (32) has an outlet (31) which engages directly with the dispenser aperture (27). The container (32) is held in position by means of a resilient bracket (37) which hooks over the outside of the toilet bowl rim (25) at one end and is located within an opening (38) in the top of the container (32). The portion of the bracket (37) which extends into the opening is essentially tubular and the consumer can fill or re-fill the container (32) from a bottle via this tube (39).

The bracket (37) may be adjustable to accommodate different sizes and configurations of toilet bowl rims (35). A removal means (40) may be provided at the other end of the dispenser (24) to make it easier to remove the dispenser (24)

from the toilet bowl together with its filling means. This removal means (40) may also be adjustable to accommodate different sizes of rims (25).

The removal means (40) may also support means for venting the dispenser (24) although suitable venting means may be provided, if desired, at any point on the dispenser (24). In this embodiment an outlet is connected to the end of the dispenser (24), which outlet comprises a venting pipe which runs along a surface of the removal means (40) ending in a vertical pipe in open contact with the air. The pipe and outlet diameters are chosen to avoid overflowing.

Figure 22:
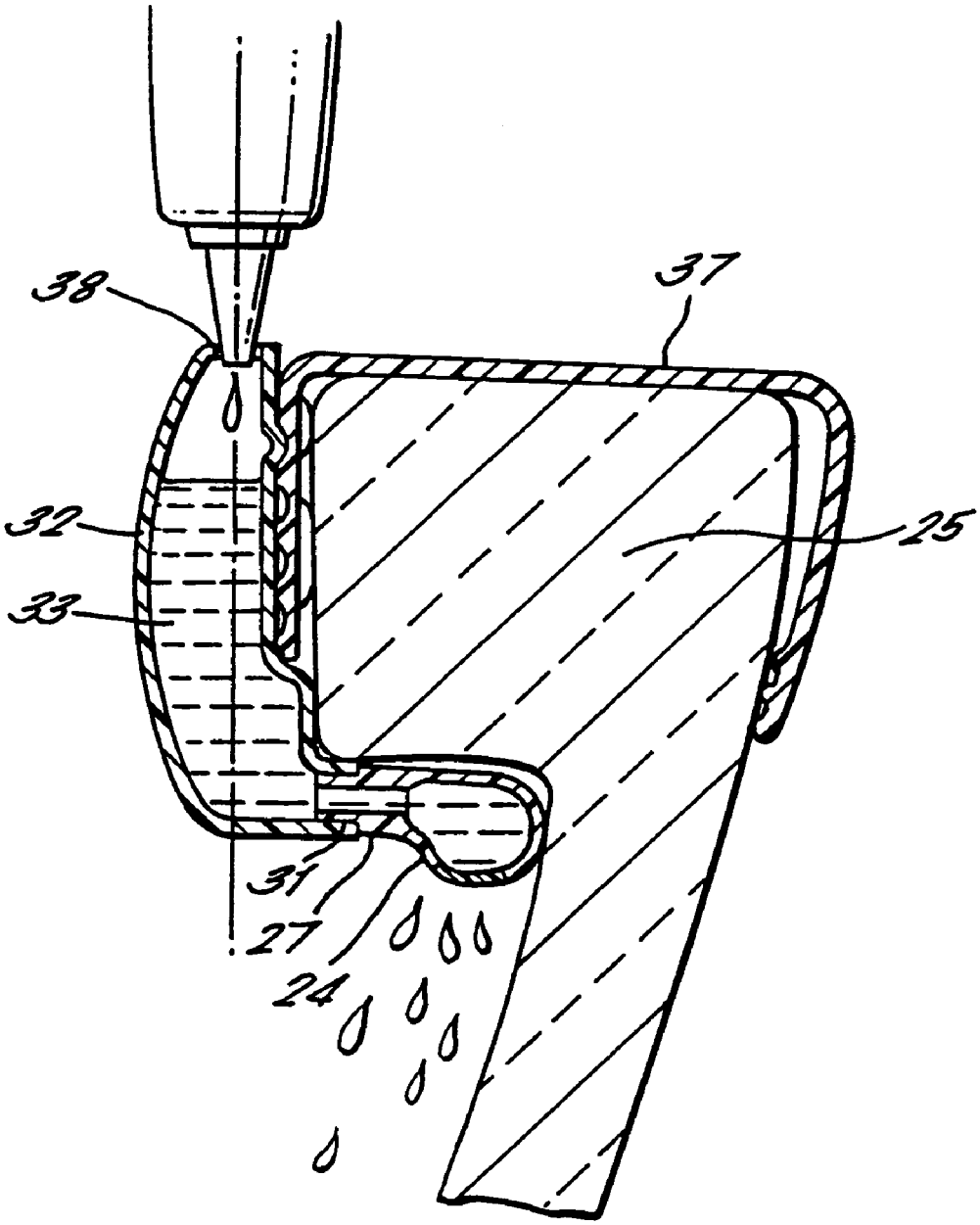

FIG. 22 shows a slightly adapted version of the filling system of FIGS. 19 to 21. In this embodiment the container outlet (31) locates around the aperture (27). Additionally the bracket (37) is attached in a different manner to the container (32), in this instance it is attached to a rear of the container via appropriate means and not via a tube inserted into the container opening (38). To fill the container of this embodiment of the filling system a simple opening (38) is provided in the top of the container (32).

In FIGS. 23 and 24 there is shown an embodiment of a dispenser showing an alternative way to adjust the length of the elongate member (41).

The elongate member (41) comprises a section of greater diameter **(41*a*) and a section of smaller diameter (41*b*). The diameters of the sections (41*a*), (41*b*) are selected so that the section of smaller diameter (41*b*) fits and slides inside the section of larger diameter (41*a*), whilst still making a fluid-type seal therebetween. At opposite ends of the sections (41*a*), (41*b*) to where they meet, they each fit onto or inside tubular arms (42) of a T-piece connector (43). The third arm (44) of the T-piece connector receives a funnel (29) from a container (32). Obviously the specific filling system may be any of those described above, which communicate directly with the T-piece connector arm (44)**.

We claim:

1. A dispenser for releasing a liquid substance into a toilet bowl, comprising a non-porous elongate resilient tubular member for retaining a liquid substance and at least partially releasing the substance when the toilet is flushed, said tubular member being of sufficient resilience and length so that it is longitudinally self-supportable under the rim of a toilet bowl, wherein the tubular member has at least one opening closed by a porous material which allows liquid but not solid substances to pass through such that, when saturated with a liquid substance in use, said dispenser enables the release of at least a part of the substance when the toilet is flushed.

2. A dispenser as according to claim 1 in which the porous material is located in the at least one opening in the tubular member.

3. A dispenser according to claim 2 in which the opening in the tubular member comprises a single slit running along its entire length, in which is located a continuous elongate insert of porous material.

4. A dispenser according to claim 2 in which the tubular member has a plurality of openings along its length, in each of which is located an insert of porous material.

5. A dispenser according to claim 1 in which the porous material covers the at least one opening in the tubular member.

6. A dispenser according to claim 5 in which the at least one opening in the tubular member comprises a single slit running along substantially its entire length.

7. A dispenser according to claim 5 in which the at least one opening in the tubular member comprises a plurality of slits along its length.

8. A dispenser according to claim 5 in which the porous material is provided in the form of a cylinder encapsulating the tubular member.

9. A dispenser according to claim 5 in which the porous material is provided in the form of a cylinder located within the tubular member.

10. A dispenser according to claim 2 or 5 in which the porous material is provided in the form of an arcuate section attached to the tubular member to close the at least one opening.

11. A dispenser according to claims 1 which is deformable to form a circular or near-circular loop and which comprises means to enable the circumference of the loop to be altered.

12. A dispenser according to claim 11 in which the circumferential length altering means comprises a clip adapted to hold the elongate tubular member at each of its ends.

13. A dispenser according to claim 12 in which the circumferential length altering means is provided by a second elongate resilient member having a greater diameter than the aforementioned elongate resilient tubular member and in which said aforementioned elongate resilient tubular member is telescopically received.

14. A dispenser according to claims 1 further comprising a removal means adapted to be placed around the outer rim of the toilet bowl to enable the dispenser to be removed from the bowl after use.

15. A dispenser according to claims 1 further comprising a substance to be released into the toilet bowl.

16. A dispenser according to claim 15 wherein the substance comprises at least one of a bleach, cleaner, surfactant, perfume or disinfectant.

17. A dispenser according to claim 15 comprising inlet means through which the resilient tubular member may be refilled with the substance.

18. A dispenser according to claim 17 further comprising a container for storing a quantity of the substance, said container being in communication with the inlet means.

19. A dispenser according to claim 18 in which the container is removably attachable to the dispenser.

20. A dispenser according to claim 18 further comprising a bracket for supporting the container on the rim of the toilet bowl.

21. A dispenser according to claim 20 in which the bracket further provide a conduit inserted into the inlet means of the container.

22. A dispenser according to claim 18 in which the container has inlet means through which the container may be refilled with the substance.

23. A dispenser according to claim 18 further including adhesive means for attaching the container to the rim of the toilet bowl.

24. A dispenser according to claim 15 wherein said tubular member has a length such that, in use, the substance is released into the toilet bowl around the entire circumference of the rim of said toilet bowl.

* * * * *

UNITED STATES PATENT AND TRADEMARK OFFICE

CERTIFICATE OF CORRECTION

PATENT NO. : 6,993,796 B1
APPLICATION NO. : 09/913130
DATED : February 7, 2006
INVENTOR(S) : Yannic Hermouet and Geoffrey Robert Hammond It is certified that error appears in the above-identified patent and that said Letters Patent is hereby corrected as shown below:

Claims:

Claim 11 (col. 6, line 14): replace “claims” with --claim--
Claim 14 (col. 6, line 28): replace “claims” with --claim--
Claim 15 (col. 6, line 32): replace “claims” with --claim--

Signed and Sealed this

Fifteenth Day of August, 2006

JON W. DUDAS
*Director of the United States Patent and Trademark Office*